US006231249B1

(12) United States Patent
Harris

(10) Patent No.: US 6,231,249 B1
(45) Date of Patent: May 15, 2001

(54) DUPLEX PRINTER USING A RIBBON SHIFTING MECHANISM

(75) Inventor: Richard Hunter Harris, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/397,294

(22) Filed: Sep. 15, 1999

(51) Int. Cl.[7] ..... B41J 3/60
(52) U.S. Cl. ..... 400/188; 400/211
(58) Field of Search ..... 400/188, 214, 400/466, 648, 209, 211, 213, 215.3, 217, 189, 216, 210.1, 248.1

(56) References Cited

U.S. PATENT DOCUMENTS

| | | | | |
|---|---|---|---|---|
| 4,755,071 | | 7/1988 | Kato | 400/188 |
| 4,820,068 | * | 4/1989 | Mitcham | 400/216.1 |
| 4,932,798 | * | 6/1990 | Kardinal et al. | 400/120 |
| 5,067,833 | * | 11/1991 | Gomoll et al. | 400/213 |
| 5,123,760 | * | 6/1992 | Tsuru et al. | 400/216.3 |
| 5,131,765 | * | 7/1992 | Bradley et al. | 400/55 |
| 5,154,520 | * | 10/1992 | Muto et al. | 400/216.1 |
| 5,156,464 | * | 10/1992 | Sakai | 400/56 |
| 5,360,279 | * | 11/1994 | Asai et al. | 400/216.1 |
| 5,533,817 | | 7/1996 | Harris et al. | 400/124.28 |
| 5,677,722 | | 10/1997 | Park | 347/218 |
| 5,865,547 | | 2/1999 | Harris et al. | 400/578 |

* cited by examiner

*Primary Examiner*—Ren Yan
*Assistant Examiner*—Darius N. Cone
(74) *Attorney, Agent, or Firm*—John D. Flynn; Ronald V. Davidge

(57) ABSTRACT

A duplex printer for printing on opposite sides of a document includes a ribbon shifting mechanism for moving a printing ribbon between a first position, in which the ribbon extends between a print head and the document for printing on a front side of the document, and a second position, in which the ribbon extends between the document and a platen for printing on a reverse side of the document. In one version of the printer, the ribbon is shifted as a carriage used to move the print head within a printing range, within which printing occurs, is moved outside this printing range into a ribbon shifting range.

21 Claims, 3 Drawing Sheets

DUPLEX PRINTER USING A RIBBON SHIFTING MECHANISM

BACKGROUND OF THE INVENTION

1. Field of the Invention

This invention relates to a means for printing on printing on both sides of a paper document, and, more particularly, to printing automatically on both sides of a check at a point of sale terminal with a single print mechanism.

2. Description of the Related Art

In continuing attempts to provide more efficient and convenient service to customers, many retailers have begun to use "point of sale check printers" to reduce the time required for a customer to fill out and sign a check. Such a printer automatically enters the date, amount of purchase, and the name of the retail establishment, to which payment is being made, in the corresponding spaces of a check provided by the customer. The signature line is left blank, for the customer to sign after he has been presented with the printed check.

Another form of printing performed on a check by the retailer is the printing of franking information on the reverse side of the check. This information generally indicates that the check is for deposit only or that it is to be deposited only to a particular account. While it is not necessary to perform this printing operation at the point of sale, many retail establishments have a policy of printing this information, with a rubber stamp if necessary, at the point of sale, reducing the possibility of unrecoverable losses from checks stolen without franking information, which are later stamped or printed with forged information. It is therefore desirable for a point of sale check printer to be able to print on both sides of the check, with the amount of the check and the name of the retail establishment being printed on the front side of the check, and with the franking information being printed on the reverse side.

One method for printing on both sides of a check simply places an additional burden on the cashier using the point of sale terminal. The check is inserted into the printer for printing on a first side, removed, turned over, and then inserted into the printer for printing on the second side. While this method is the simplest in terms of the hardware required, the additional operations required to be performed by the cashier increase the time required for a transaction while also reducing the chance that the printing operation will be performed correctly.

Some printers provide for printing on both sides of a sheet of paper with two separate print mechanisms, operating on opposite sides of the sheet of paper. However, this approach naturally increases the complexity of the printer mechanism while tending to reduce its reliability.

The patent art describes other printers which provide for printing on both sides of the paper with a single print head. U.S. Pat. No. 4,755,071 describes a device in which printing is performed on both sides of a sheet of paper fed between a wire matrix print head and a cylindrical platen extending parallel to the direction in which the print head is reciprocated. The cylinder has a solid segment and a porous segment, composed, for example, of a sintered Nylon, impregnated with ink. Printing on a front side of the paper occurs as the print head is moved in an advancing direction, with an ink-impregnated printing ribbon extending between the print head and the paper, and with the platen rotated so that the solid segment is adjacent the paper in the area where printing is taking place. Printing on the back side of the paper occurs as the print head is returned opposite the advancing direction, with the ribbon lifted out of engagement with the print head wires, and with the platen rotated so that a porous, inked segment extends adjacent the paper in the area where printing is taking place. Multicolor printing can be accomplished with multicolored strips of ink extending along the ribbon and with multiple segments of the platen having different colors of ink.

Japanese Application, Publication Number 01-186369, published Jul. 25, 1989, describes another method for printing on both sides of the paper with a single print head, with the paper being fed between a pair of printing ribbons. Each of the printing ribbons includes a strip infiltrated with ink and a strip without ink. The ribbons are arranged so that the inked portion of each ribbon is adjacent the non-inked portion of the other ribbon. For example, a first side of the document is printed with the print head moving in an advancing direction, and with both ribbons in a raised position, so that the inked portion of the first ribbon lies adjacent the print head and the non-inked portion of the second ribbon. The second side of the document is printed as the head is returning opposite the advancing direction, and with both ribbons in a lowered position, so that the inked portion of the second ribbon lies adjacent the print head and the non-inked portion of the first ribbon.

Because of the nature of information to be printed on a check, and because of long-standing conventions in the banking industry, it is particularly desirable to provide biaxial printing at a point of sale check printing terminal. The information to be printed on the front side of the check, such as the organization to which payment is to be made and the amount to be paid, must be printed in a longitudinal direction along the check, while the franking information to be printed on the reverse side of the check must be printed in a transverse direction along a relatively narrow area at an end of the check. Printing in the longitudinal direction, parallel to a long side of a document, is generally called "landscape" printing, while printing in the transverse direction, parallel to a short side of the document, is generally called "portrait" printing.

Thus, the inventions of U.S. Pat. No. 4,755,071 and Japanese Application, Publication No. 01-186369 have a disadvantage, when considered for use in a point of sale check printer, of printing a line at a time on alternating sides of the document. There is no provision for printing in directions perpendicular to one another.

U.S. Pat. No. 5,533,817 describes a biaxial printer having a print head with a column of print wires arranged at an angle between 0 and 90 degrees relative to a permitted line of motion of the print head. For example, the column may be arranged at 45 degrees relative to this line of motion. This angled print head allows for both portrait and landscape printing, with portrait mode printing being performed by controlling movement of the angled print head along the permitted line of motion during the printing of each line of images, and with landscape mode printing being performed by maintaining a stationary position of the print head while the document is moved in a direction perpendicular to the permitted line of motion of the print head. This type of printing is particularly useful for the application of point-of-sale check printing, since only two or three lines of information is to be printed on each side of the check. In such an application, it is particularly desirable to be able to finish the printing operation quickly, since there often are a number of people waiting in line to check out merchandise.

U.S. Pat. No. 5,865,547 describes a print head and check flipper subassembly having a removable flipper cartridge to allow printing on both sides of a check or other document in one continuous operation. A check is fed downward, between a print head and platen, with printing occurring on a first side of the check, and into a loop within the flipper cartridge. The check continues around the loop, and is driven out of the loop, having been reversed front to back. The check is fed upward between the print head and platen, with printing occurring on a second side of the check, and outward through the slot into which it has been inserted. This patent also describes the use of a Magnetic Ink Character Recognition (MICR) reader to read the characters extending along the lower edge of the check to determine the customers bank and his account number.

What is needed is a printer capable of printing on both sides of a document, and in directions perpendicular to one another, without requiring the complexity of a paper path having a capability of flipping the document.

BRIEF SUMMARY OF THE INVENTION

According to a first aspect of the present invention, there is provided a duplex printer, for printing on both sides of a document. The duplex printer includes an impact print head, a platen, a ribbon, and a ribbon shifting mechanism. The platen is disposed in a spaced-apart relationship with the impact print head. The ribbon shifting mechanism is movable between a disengaged position, in which the ribbon is held adjacent the impact print head and in a spaced-apart relationship with the platen, and an engaged position, in which the ribbon is held adjacent the platen and in a spaced-apart relationship with the impact print head.

According to a second aspect of the present invention, there is provided a method for printing on first and second opposite sides of a document, comprising steps of:

(a) moving the document in a first direction between an impact print head and a platen, with a printing ribbon extending adjacent the first side of the document;

(b) forming a printing pattern with the impact print head by selectively moving portions of the impact print head toward the platen, with ink being transferred from the printing ribbon to the first side of the document;

(c) moving the document in the first direction into a first ribbon shifting document position allowing movement of the printing ribbon between a position adjacent the impact print head and a position adjacent the platen;

(d) shifting the printing ribbon in a second direction between the position adjacent the impact print head and the position adjacent the platen;

(e) moving the document opposite the first direction between the impact print head and the platen, with the printing ribbon extending adjacent the second side of the document; and (f) forming a printing pattern with the impact print head by selectively moving portions of the impact print head toward the platen, with ink being transferred from the printing ribbon to the second side of the document.

DETAILED DESCRIPTION OF THE INVENTION

Figure 1:
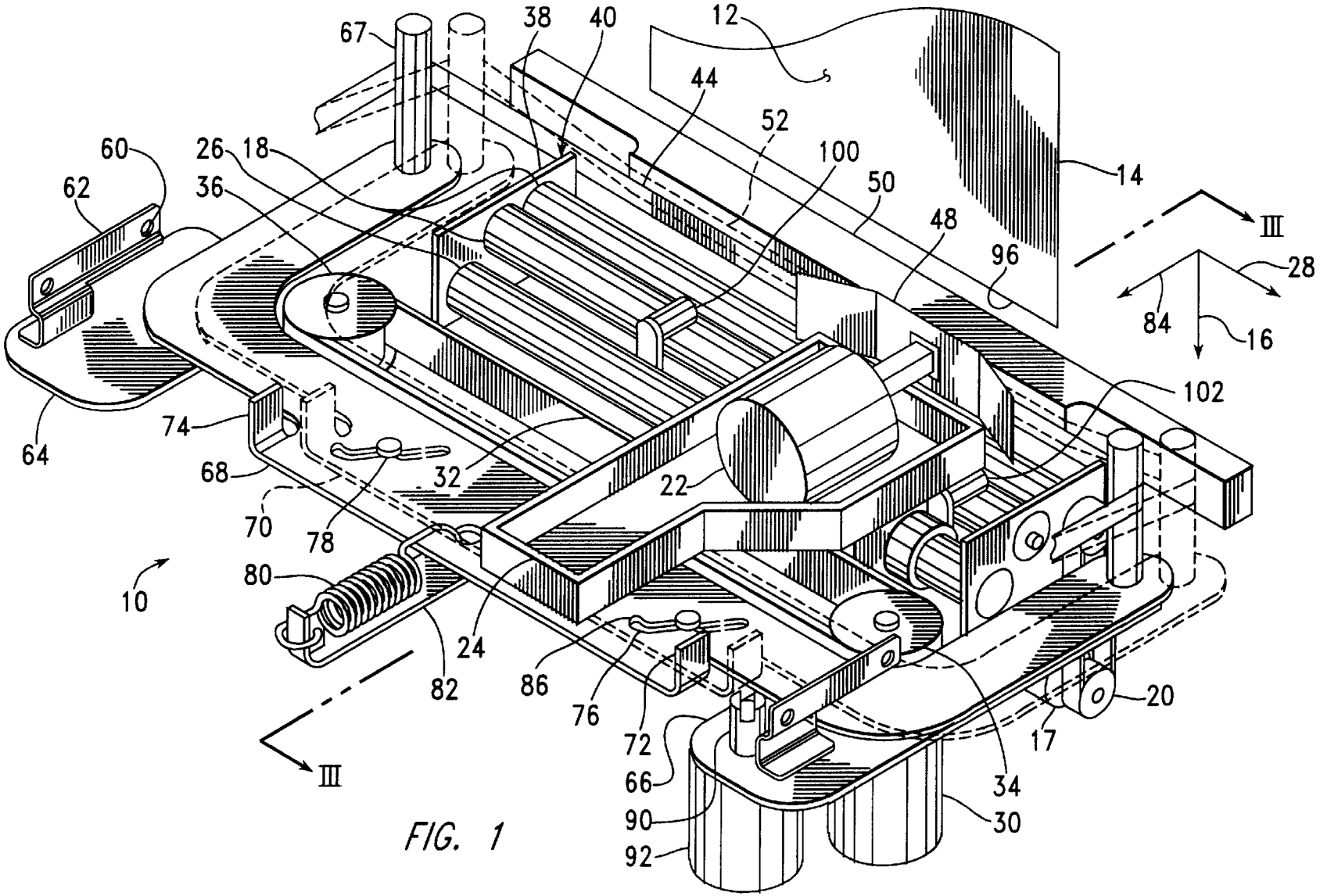
FIG. 1 is a front right isometric view of a duplex printer built in accordance with the present invention.

FIG. 1 is a front right isometric view of a duplex printer 10 built in accordance with the present invention. The duplex printer 10 is configured for printing on both front side 12 of a document 14 and on the reverse side thereof as the document is fed downward, in the direction of arrow 16, into the printer 10, and upward, opposite the direction of arrow 16, out of the printer 10. Motion of the document 14 within the printer 10 is provided by a paper feed motor 17, which turns one or both of the document feed rolls 18 by means of a belt drive 20. During the process of printing, characters are formed by a impact print head 22, which attached to a carriage 24. The impact print head 22 is of general type generating patterns to be moved by moving certain structures toward the document 12. For example, the impact print head 22 may include a matrix of wires which are moved to form characters in succession. The carriage 24 is slidably mounted on a rail 26 to move in and opposite to the advancing direction indicated by arrow 28, being driven by a transport motor 30 through a transport belt 32 extending around a driven pulley 34 and an idler pulley 36. The rail 26 is mounted to extend between a pair of sideplates 38 extending upward as portions of a frame generally indicated as 40, while the document feed rolls 18 are rotatably mounted within these sideplates 38.

Figure 2:
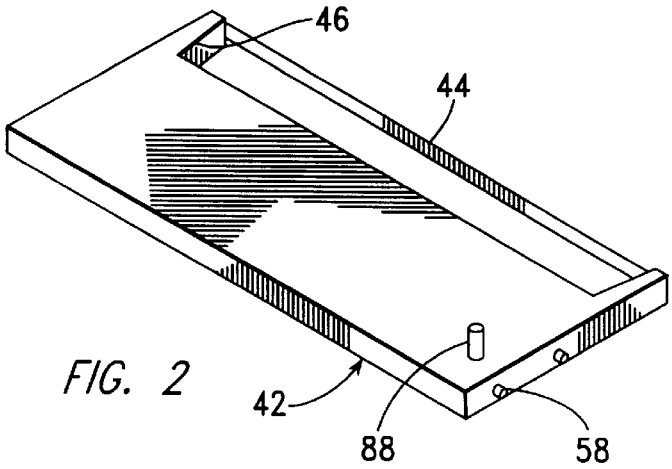
FIG. 2 is a front right isometric view of a printing ribbon cartridge used with the duplex printer of FIG. 1.

FIG. 2 is a plan view of a ribbon cartridge 42, including an inked ribbon 44 which is stored on spools (not shown) within the cartridge 42 and which is stretched between a pair of cartridge ribbon guides 46 to facilitate the printing process.

Figure 3:
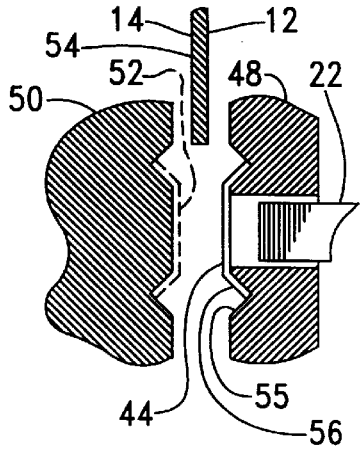
FIG. 3 is a fragmentary vertical cross-sectional view of the duplex printer of FIG. 1, taken as indicated by section lines III—III therein.

FIG. 3 is a fragmentary vertical cross sectional view, taken as indicated by section lines III—III in FIG. 1, showing the ribbon 44 extending between the cartridge ribbon guides 46 (shown in FIG. 2) in a forward position, held against a central ribbon guide 48. In this forward position, the ribbon 44 is used to print on the front side 12 of the document 14, with the print wires (not shown) of the wire matrix print head 22 impacting on the ribbon 44, which in turn impacts on the document 14. This printing process is supported by a platen 50 extending behind the document 14 to absorb the impact forces generated by the movement of print wires. Dashed lines 52 indicate a rearward position of the ribbon 44, as it is held against the platen 50. In this rearward position, the ribbon 44 is used to print on the reverse side 54 of the document 14, with the print wires impacting on the document 14, which in turn impacts on the ribbon 44. This printing process is again supported by the platen 50 extending behind the document 14 to absorb the impact forces generated by the movement of print wires. Preferably, both the central ribbon guide 48 and the platen 50 have alignment grooves 55 into which edge portions 56 of the ribbon 44 are pulled to aid in maintaining the alignment of the ribbon 44 during the printing process.

Referring to FIGS. 1–3, the ribbon cartridge 42 is installed on the printer 10, with cartridge alignment posts 58 extending through corresponding cartridge alignment holes 60 in cartridge mounting clips 62, which extend upward from tabs 64, 66 of the frame 40. As the ribbon cartridge 42 is installed in this way, the portion of the ribbon 44 stretched between cartridge ribbon guides 46 is also stretched partially around a pair of ribbon guide rollers 67 extending upward from a ribbon shifting plate 68. With the ribbon shifting plate 68 in the disengaged position in which it is shown, these ribbon guide rollers 67 allow the ribbon 44 to be held against the central ribbon guide 48. With the ribbon shifting plate in the alternate engaged position indicated by dashed lines 70, the ribbon guide rollers 67 pull the ribbon 44 into a position in which it is stretched along the platen 50, as indicated by dashed lines 52.

The ribbon shifting plate 68 is moved between the disengaged position in which it is shown and the engaged position indicated by dashed lines 70 by movement of the carriage 24, in the advancing direction indicated by arrow 28 and opposite thereto, beyond the range used for printing. The ribbon shifting plate 68 includes an engaging tab 72, which is contacted by the carriage 24 as this carriage 24 is driven past the range used for printing in the advancing direction of arrow 28 to move the ribbon shifting plate 68 from the disengaged position in which it is shown to the engaged position indicated by dashed lines 70. Similarly, the ribbon shifting plate 68 includes a disengaging tab 74, which is contacted by the carriage 24 as this carriage 24 is driven past the range used for printing opposite the advancing direction of arrow 28 to move the ribbon shifting plate 68 from the engaged position indicated by dashed lines 70 to the disengaged position in which it is shown.

The path of movement of the ribbon shifting plate 68 is determined by a pair of alignment slots 76, within the plate 68, which slide along alignment posts 78 extending upward from a part of the frame 40. An extension spring 80, operating between the ribbon shifting plate 68 and a tab 82, formed as part of the frame 40, pulls the ribbon shifting plate 68 in the forward direction of arrow 84, so that the rightmost ends of the alignment slots 76 are held against the alignment posts 78, in the position shown in FIG. 1, after the carriage 24 moves away from the disengaging tab 74. The leftmost ends of the alignment slots 76 are configured as detent surfaces 86, extending at an oblique angle in a direction away from the direction of arrow 84, so that the extension spring 80 also holds the ribbon shifting plate 68 in a stable position, with the detent surfaces 86 extending partly around the alignment posts 78, in the engaged position indicated by dashed lines 70, after the carriage 24 moves away from the engaging tab 72.

Thus, the transport motor 30, through the movement of carriage 24, controls both the position, in the direction of arrow 28, at which information is printed on the document 14, and the ribbon position as required for printing on either the front or reverse side of the document 14, with movement of the carriage through a central printing range, where printing takes place, and with movement of the carriage into ribbon shifting ranges outside the central range being used to shift the ribbon position.

When the ribbon cartridge 42 is installed within the cartridge mounting clips 62, a shaft extending within the ribbon cartridge 42 and upward therefrom as a knob 88 engages a drive coupling 90 extending upward from a ribbon drive motor 92 fastened to the tab 66 of frame 40. This motor drives a conventional mechanism within the ribbon cartridge 42 to present new portions of the ribbon 44 to the area in which printing is taking place and to maintain tension within the portion of the ribbon 44 extending between the cartridge ribbon guides 46.

The duplex printer also includes a sensor 100, and an MICR reader 102. The sensor 100 may be, for example, a conventional optical device, for sensing the presence or absence of a document 14 in a position closely spaced above the document feed rolls 18. The MICR reader 102 is also a conventional type of device for reading the characters printed in magnetic ink along the lower edge of a check. Information read in this way can be use to verify the customer's account in the manner described in U.S. Pat. No. 5,865,547.

Figure 4:
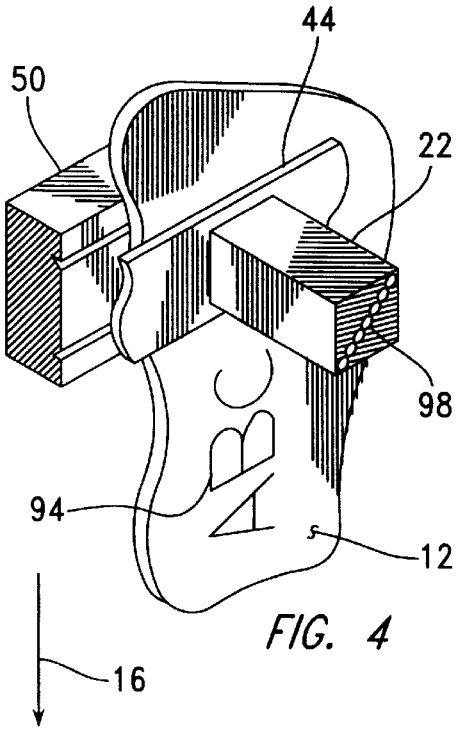
FIG. 4 is a fragmentary front left isometric view of a printing area of the duplex printer of FIG. 1, showing printing on the front side of a document.
Figure 5:
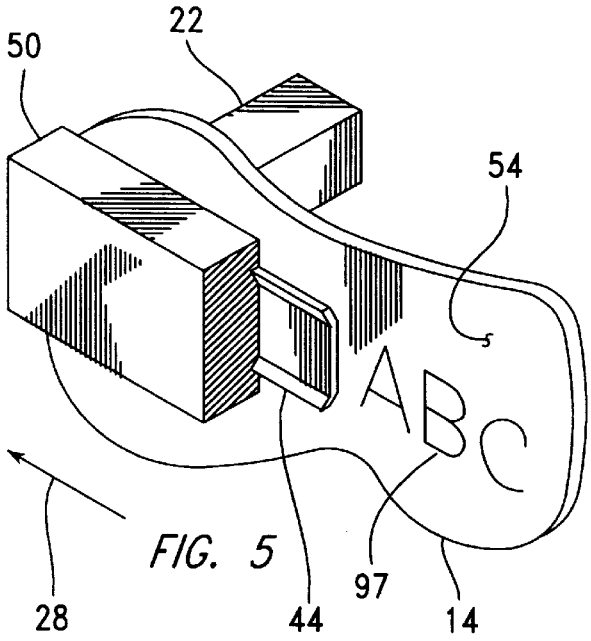
FIG. 5 is a fragmentary rear isometric view of the printing area of FIG. 5, showing printing on the reverse side of a document.

FIG. 4 is a fragmentary front left isometric view of a printing area of the duplex printer 10 of FIG. 1, showing printing on the front side 12 of the document 14, while FIG. 5 is a fragmentary rear isometric view of the printing area, showing printing on the reverse side 54 of the document 14. The central ribbon guide 48, otherwise shown in FIGS. 1 and 3, is omitted in FIGS. 4 and 5 to avoid obscuring the relationships among the elements shown. FIG. 4 shows characters 94 printed as the document 14 is moved downward, in the direction of arrow 16, with the print head 22 being held stationary, and with the ribbon 44 between the print head 22 and the document 14. FIG. 5 shows characters 97 printed as the print head 22 is moved in the advancing direction of arrow 28 with the document 14 being held stationary. The print wires 98 within print head 22 extend in a line at oblique angles with both of the directions of arrows 16, 22 in which printing occurs, so that a single line of print wires can be used for printing in both of these directions, and opposite to both of these directions, in the general manner described in U.S. Pat. No. 5,533,817.

A first method for operating the duplex printer 10 as a point of sale check printer will now be described, with particular reference being made to FIGS. 1, 4, and 5. A check to be printed is first manually placed in a slot (not shown) having a guiding edge against which the lower longitudinal edge (i.e. the edge along which MICR numbers are ordinarily printed) against a guide. This process takes advantage of the fact MICR characters are located relative to this edge.

The process begins with the ribbon transfer shifting plate 68 in the disengaged position in which it is shown, with the ribbon 44 configured for printing on the front side 12 of the document 14, which in this application is a check to be printed, as shown particularly in FIG. 4, having been left in this configuration following a previous printing operation. Optionally, the printing process may always begin with the carriage 24 being driven opposite the advancing direction of arrow 28 to an extreme position, so that the ribbon shifting plate 68 is moved into the disengaged position whenever it is not already in this position.

The process of printing an individual check begins as a first (lower) end, of the check 14 to be printed, is inserted into the duplex printer, being pushed downward, in the direction of arrow 16, as the check 14 is manually inserted or as it is drawn into the printer 10 with the aid of additional feed rolls (not shown). As the check is being inserted, the carriage drive motor 30 is used to move the carriage 24, in and opposite to the direction of arrow 28, into a position in which the print head 22 is aligned with the position in which the first line of information is to be printed on the front side 12 of the check 14. As the first (lower) end 96 of the check 14 approaches the document feed rolls 18, the sensor 94 indicates its presence, so that the feed rolls 18 are then driven to continue the movement of the check in the direction of arrow 16. During this continued movement downward, past the feed rolls 18, the first line of information to be printed on the front side of the check is printed, and the magnetic ink characters extending along the lower edge of the check 14 are read by the MICR reader 102. The information obtained in this way by be used to verify the customers account. This first line of information is, for example, the amount of money to be paid, written out in words. When the upper edge of the check 14 moves past the sensor 94, the output of this sensor causes the document drive motor 17 to stop with an upper end portion of the check between the document feed rolls 18, but with the entire check 14 moved below the point at which its presence interferes with the transfer of the printing ribbon 44 between the position in which it is shown in FIG. 1 and the position in which it is indicated by dashed lines 52.

Next, the carriage drive motor 30 is turned on to move the carriage 24 in the direction of arrow 28 until contact between the carriage 24 and the engagement tab 72 causes movement of the ribbon shifting plate 68 from the disengaged position in which it is shown into the engaged position indicated by dashed lines 70. This movement of the ribbon shifting plate 68 causes the ribbon 44 to be transferred from the position of FIG. 4 to the position of FIG. 5.

Next, the document feed motor 17 is turned on to drive the check 14 upward, opposite the direction of arrow 16, until the location of the check where the first line of franking information is to be printed on the reverse surface 54 of the check is aligned with the print head 22. The carriage drive motor 30 is then used to drive the carriage 24 opposite the direction of arrow 28 as this first line of franking information is printed. If more than one line of franking information is to be printed, the carriage drive motor 30 is used to move the carriage 24 back and forth across the check 14 as these various lines are printed, with the document feed motor 17 moving the check 14 through suitable distances between the positions in which lines are printed.

When the printing of franking information has been completed, the document drive motor 17 again moves the check 14 downward, in the direction of arrow 16, until the sensor 100 indicates that the upper edge of the check 14 has cleared the path through which the ribbon can be shifted, with the upper portion of the check 14 still lying between the document feed rolls.

Next, the carriage drive motor 30 moves the carriage 24 opposite the direction of arrow 28 until contact between the carriage 24 and the disengaging tab 74 causes the ribbon shifting plate to be moved from the engaged position indicated by dashed lines 70 to the disengaged position in which it is shown in FIG. 1. In this way, the ribbon is shifted into position for printing the front surface 12 of the check 14.

Next, the carriage drive motor 30 moves the carriage in the direction of arrow 28 until the print head 22 is aligned with the position in which the second line of information is to be printed on the front side 12 of the check 14. The first line of information being printed is, for example, the name of the organization to be paid with the check and the amount of money to be paid, written in numerals. In this way, this information is correctly aligned with the top edge of the check 14, which is the edge closest to the place where the amount of money is written in numerals, regardless of the length of the check. Then the document feed motor is turned on to drive the check 14 upward, with the second line of information being printed as the check 14 is moved upward. After the check 14 is moved out of the document feed rolls 18, it is removed manually or by being driven through additional feed rolls (not shown).

A second method for operating the duplex printer 10 as a point of sale check printer will now be described, with continuing reference being made to FIGS. 1, 4, and 5. Again, the process begins with the ribbon shifting plate 68 in the disengaged position in which it is shown, with the ribbon 44 configured for printing on the front side 12 of the document 14, and with a first (lower) end 96, of the check 14 to be printed, is manually inserted into the duplex printer 10, being pushed down, in the direction of arrow 16, manually or by additional feed rolls (not shown). The output of sensor 94 provides a determination that the lower end 96 of the check 14 is approaching the document feed rolls 18, causing rotation of the document feed rolls to begin. This rotation occurs until the operation of the sensor 94 indicates that the upper edge of the check 14 has moved past this sensor. Since subsequent operations handling the check 14 require maintaining the check within the document feed rolls 18 while the check is moved up and down, the angular distance through which the motor 20 is operated to drive the rolls 19 until the check moves below the sensor is stored as an indication of the length of the check. During the first downward movement of the check 14 within the duplex printer 10, a printing operation does not occur, but the magnetic ink characters previously printed along the longitudinal edge of the check are read by the MICR reader 102.

Next, the carriage 24 is moved in or opposite the direction of arrow 28 by the carriage drive motor 30, until the print head 22 is determined to be aligned with the location at which a first line of information is to be printed on the front side 12 of the check 14, and the check 14 is moved upward, opposite the direction of arrow 16, while this first line of information is printed. This first line of information is, for example, the name of the organization to which funds are to be paid, and the amount to be paid, written in numbers. The distance through which the check 14 is moved upward is limited by the previously stored information indicating the length of the check 14, so that this movement is stopped with the lower end portion of the check 14 still between the document feed rolls 18.

Similarly, the carriage 24 is next moved in or opposite the direction of arrow 28 by the carriage drive motor 30, until the print head 22 is determined to be aligned with the location at which a second line of information is to be printed on the front side 12 of the check 14, and the check 14 is moved downward, in the direction of arrow 16, while this second line of information is printed. This second line of information is, for example, the amount to be paid, written in words. The distance through which the check 14 is moved downward is limited as the upper end of the check 14 moves past the sensor 100. In this position, the check 14 is moved below the ribbon 44, so that the ribbon 44 can be shifted between the positions of FIGS. 4 and 5.

Next, the carriage 24 is moved in the advancing direction of arrow 28 by the carriage drive motor 30 until contact between the carriage 24 and the engaging tab 72 moves the ribbon shifting plate 68 into the engaged position indicated by dashed lines 70, with the ribbon 44 being moved against the platen 50 as shown by dashed lines 52 in FIG. 1 and as shown in FIG. 5.

Next, the check 14 is moved upward, by means of the document feed motor 17, until the position at which a first line of franking information is to be printed on the reverse side 96 of the check 14 is aligned with the print head 22. Then the carriage 24 is moved opposite the advancing direction of arrow 28 as the first line of franking information is printed. For example, this line may read, "For deposit to account:"

Next, the check 14 is moved by the document feed motor 17 until the position at which a second line of franking information is to be printed on the reverse side 96 of the check 14 is aligned with the print head 22. Then the carriage 24 is moved in the advancing direction of arrow 28 as the second line of franking information is printed. For example, this line may indicate the bank account number of the organization to be paid.

Next, the check 14 is moved upward by the document feed motor 17 until the previously stored information indicating the length of the check 14 is used to determine that the lower edge 96 has been moved past the document feed rolls 18. After the check 14 has been removed upward, opposite the direction of arrow 16, either manually or by means of additional feed rolls (not shown), as determined from the output of the sensor 100, the carriage 24 is moved opposite the advancing direction of arrow 28 until contact between the carriage 24 and the disengagement tab 74 causes the ribbon shifting plate 68 to be moved into the disengaged position in which it is shown, with the ribbon being moved to extend against the central ribbon guide 48.

Figure 6:
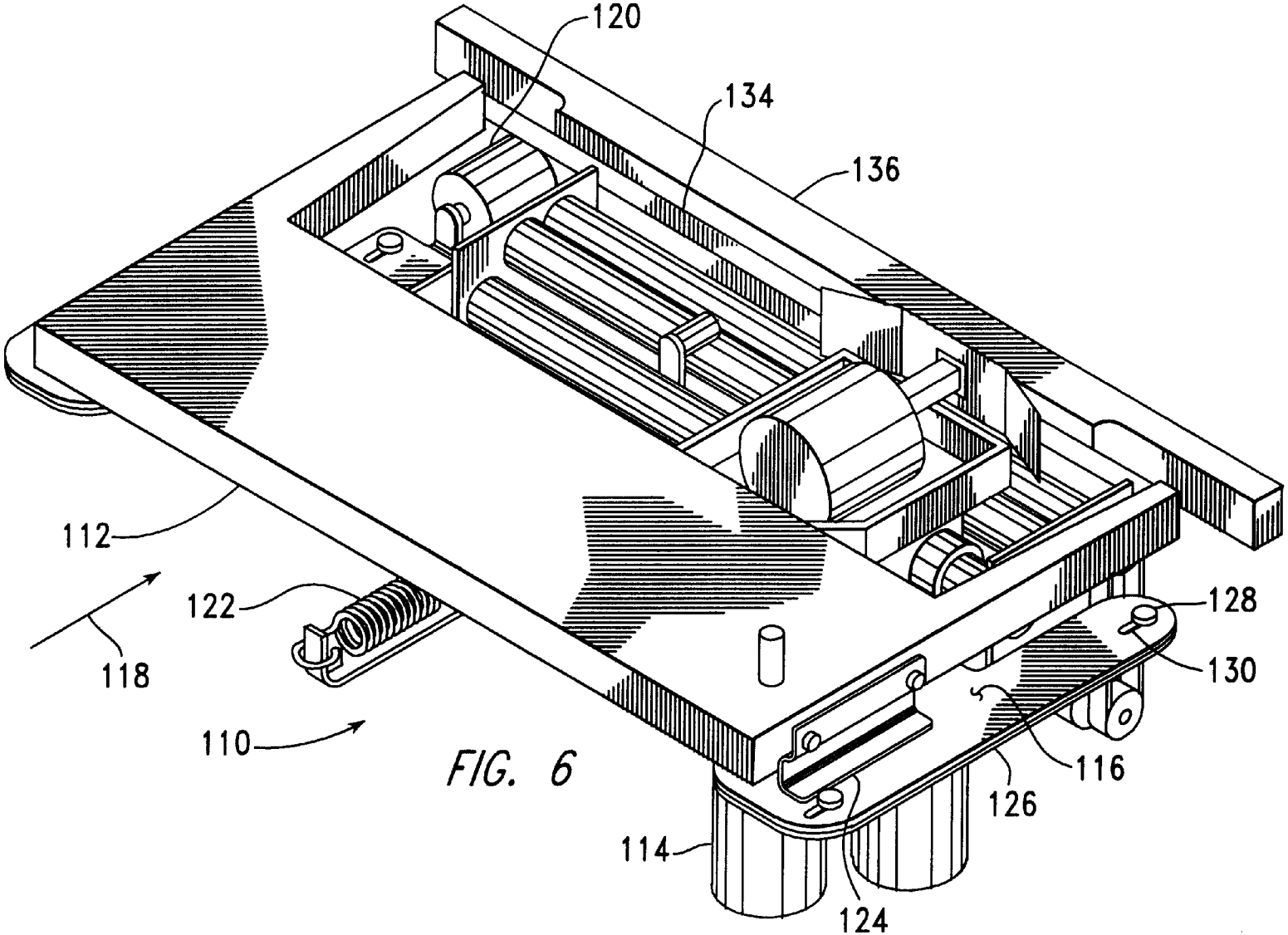
FIG. 6 is a front right isometric view of a duplex printer built in accordance with an alternative embodiment of the present invention.

FIG. 6 is a front right isometric view of an alternate embodiment 110 of a duplex printer built in accordance with the present invention. In this alternate embodiment 110, the ribbon cartridge 112 and the ribbon drive motor 114 are attached to a ribbon shifting plate 116, which is pulled in the engagement direction of arrow 118, by means of a solenoid 120, and which is pulled in a disengagement direction, opposite the direction of arrow 116 by means of an extension spring 122. The ribbon cartridge 112 is held on the ribbon shifting plate 116 by means of a pair of mounting clips 124, and the ribbon shifting plate 116 slidably mounted on a frame 126 by means of a number of posts 128 extending upward from the frame 126 within slots 130 of the ribbon shifting plate 116. The cartridge ribbon guides 132 are extended to hold the ribbon 134 against the central ribbon guide 136 with the ribbon shifting plate 116 in the disengaged position in which it is shown, and to hold the ribbon 134 against the platen 136 with the ribbon shifting plate 116 moved, in the direction of arrow 118 into an engaged position. Thus, electrical current is driven through the coil of the solenoid 120 to move the ribbon 134 into position to print on the reverse side of a check, and the flow of this current is stopped to return the ribbon 134 into position to print on the front side of the check. Other aspects of this alternative embodiment 110 are as previously described in regard to the duplex printer 10 of FIG. 1.

While the present invention has been described in preferred forms or embodiments with some degree of particularity, it is understood that this description has been given only by way of example, and that numerous changes in the details of fabrication and use, including the combination and rearrangement of parts, may be made without departing from the spirit and scope of the invention. For example, rollers extending upward from the ribbon shifting plate in the manner of FIG. 1 may be used to align the ribbon in the alternate embodiment otherwise described in reference to FIG. 6.

I claim:

1. A duplex printer, for printing on opposite sides of a document, comprising:

an impact print head;

a platen disposed in a spaced-apart relationship with said impact print head, absorbing impact forces from said impact print head;

a ribbon disposed between said impact print head and said platen, wherein said ribbon is impregnated with an ink which is partially transferred from said ribbon to an adjacent surface in response to an impact force from said impact print head;

document feed rolls, moving said document between said impact print head and said platen in a document feed direction and opposite said document feed direction:

ribbon shifting means holding said ribbon, wherein said ribbon shifting means is movable between a disengaged position and an engaged position wherein said ribbon shifting means in said disengaged position holds said ribbon in a forward position, between said impact print head and said document as said document is moved between said impact print head and said platen and wherein said ribbon shifting means in said engaged position holds said ribbon in a rearward position between said platen and said document as said document is moved between said impact print head and said platen.

2. The duplex printer of claim 1, wherein said duplex printer additionally comprises a carriage, holding said impact print head, slidably mounted to move in an advancing direction and opposite said advancing direction, and carriage drive means moving said carriage in said advancing direction and opposite to said advancing direction, through a printing range in which printing occurs on a document inserted between said impact print head and said platen, and through ribbon shifting ranges at each end of said printing range, and said ribbon shifting means includes a disengaging tab moved by said carriage, moving said ribbon shifting means into said disengaged position as said carriage is moved in a first direction away from said printing range at a first end of said printing range, and an engaging tab moved by said carriage, moving said ribbon shifting means into said engaged position as said carriage is moved opposite said first direction away from said printing range at a second end of said printing range, opposite said first end of said printing range.

3. The duplex printer of claim 2, wherein said ribbon shifting means additionally includes a ribbon shifting plate mounted to slide along a preferred path as said ribbon shifting mechanism is moved between said disengaged and engaged positions, and said engaging tab and said disengaging tab extend as portions of said ribbon shifting plate into a carriage path of said carriage.

4. The duplex printer of claim 3, wherein said preferred path moves said ribbon shifting plate in said first direction and away from said platen as said ribbon shifting means is moved between said engaged position and said disengaged position, and said preferred path moves said ribbon shifting plate opposite said first direction and toward said platen as said ribbon shifting means is moved between said disengaged position and said engaged position.

5. The duplex printer of claim 4, wherein said ribbon shifting means additionally includes a spring holding said ribbon shifting plate at a first end of said preferred path, said preferred path is curved to include a detent portion at a second end of said preferred path, opposite said first end of said preferred path, and said spring additionally holds said ribbon shifting plate at said second end of said preferred path.

6. The duplex printer of claim 1, wherein said ribbon shifting means includes:

a ribbon shifting plate, holding said ribbon to extend between said impact print head and said platen, wherein said ribbon shifting plate is mounted to slide toward said platen and away from said platen; and a solenoid moving said ribbon shifting plate to move said ribbon shifting means between said disengaged position and said engaged position.

7. The duplex printer of claim 1, wherein said duplex printer additionally includes a ribbon cartridge, having a pair of spaced-apart cartridge ribbon guides, and a ribbon feed motor pulling said ribbon between said pair of spaced-apart cartridge ribbon guides; and said ribbon shifting means additionally includes guide surfaces engaging said ribbon extending between said pair of spaced-apart cartridge ribbon guides and moving said ribbon between a position extending adjacent said print head and a position extending adjacent said platen.

8. The duplex printer of claim 1, wherein said ribbon shifting means additionally includes a ribbon cartridge, having a pair of ribbon shifting guides, moving as a part of said ribbon shifting means to move said ribbon between a position extending adjacent said print head and a position adjacent said platen.

9. The duplex printer of claim 1, wherein said platen includes a first pair of ribbon guiding grooves extending in a spaced-apart relationship along said platen, and opposite edges of said ribbon are pulled into said first pair of ribbon guiding grooves as said ribbon is held adjacent said platen and in said spaced-apart relationship with said impact print head.

10. The duplex printer of claim 9, additionally comprising a central ribbon guide extending on each side of said impact print head including a second pair of ribbon guiding grooves extending in a spaced-apart direction, wherein said opposite edges of said ribbon are pulled into said second pair of ribbon guiding grooves as said ribbon is held adjacent said impact print head and in said spaced-apart relationship with said platen.

11. The duplex printer of claim 1, wherein said duplex printer additionally comprises a motor turning one of said document feed rolls; and said document is moved between said document feed rolls into a position clearing said ribbon for movement between said forward position and said rearward position.

12. The duplex printer of claim 11, additionally comprising:

a carriage, holding said impact print head, slidably mounted to move in an advancing direction perpendicular to said document feed direction and opposite said advancing direction; and carriage drive means moving said carriage in said advancing direction and opposite to said advancing direction.

13. The duplex printer of claim 12, wherein said impact print head includes a plurality of wires and wire driving means moving individual wires in said plurality thereof toward said platen to produce a pattern being printed, and said wires in said plurality thereof are arranged along a line extending at a first oblique angle with respect to said document feed direction and at a second oblique angle with respect to said advancing direction.

14. The duplex printer of claim 13, wherein printing on a first side of said opposite sides of a document occurs as said carriage is held stationary and as said document is moved by said document feed rolls; and printing on a second side of said opposite sides of a document, opposite said first side thereof, occurs as said document is held stationary and as said carriage is moved by said carriage drive means.

15. A method for printing on first and second opposite sides of a document, comprising steps of:

(a) moving said document in a first direction between an impact print head and a platen, with a printing ribbon extending adjacent said first side of said document;

(b) forming a printing pattern with said impact print head by selectively moving portions of said impact print head toward said platen, with ink being transferred from said printing ribbon to said first side of said document;

(c) moving said document in said first direction into a first ribbon shifting document position allowing movement of said printing ribbon between a position adjacent said impact print head and a position adjacent said platen;

(d) shifting said printing ribbon in a second direction between said position adjacent said impact print head and said position adjacent said platen;

(e) moving said document opposite said first direction between said impact print head and said platen, with said printing ribbon extending adjacent said second side of said document; and (f) forming a printing pattern with said impact print head by selectively moving portions of said impact print head toward said platen, with ink being transferred from said printing ribbon to said second side of said document.

16. The method of claim 15, wherein step (d) is performed by moving a carriage in which said impact print head is mounted from a printing range, in which printing occurs, to a first ribbon shifting carriage position in which contact between said carriage and a ribbon shifting plate causes said ribbon shifting plate to shift said printing ribbon in said second direction.

17. The method of claim 15, additionally comprising steps of:

(g) moving said document opposite said first direction into a second ribbon transfer position allowing movement of said printing ribbon between a position adjacent said impact print head and a position adjacent said platen;

(h) shifting said printing ribbon opposite said second direction between said position adjacent said impact print head and said position adjacent said platen.

18. The method of claim 17, wherein step (d) is performed by moving a carriage in which said impact print head is mounted from a printing range, in which printing occurs, to a first ribbon shifting carriage position in which contact between said carriage and a ribbon shifting plate causes said ribbon shifting plate to shift said printing ribbon in said second direction;

step (g) is performed by moving said carriage from said printing range to a second ribbon shifting position in which contact between said carriage and said ribbon shifting plate causes said ribbon shifting plate to shift said printing ribbon opposite said second direction.

19. The method of claim 15, wherein step b) is performed as said document is moved in said first direction while a carriage in which said impact print head is mounted is held stationary, with said impact print head in alignment with a position where a first line of information is to be printed on said first side of said document, and step (f) includes moving a carriage in which said impact print head is mounted in a direction perpendicular to said first direction, while said document is held stationary, with a position where a first line of information is to be printed on said second side of said document in alignment with said impact print head.

20. The method of claim 19, additionally comprising steps of:

(i) moving said document in said first direction into said first ribbon shifting document position; and (j) shifting said printing ribbon opposite said second direction between said position adjacent said impact print head and said position adjacent said platen.

21. The method of claim 20, additionally comprising steps of:

(k) moving said carriage in a direction perpendicular to said first direction into alignment with a position where a second line of information is to be printed on said first side of said document;

(l) moving said document opposite said first direction as a printing pattern is performed with said impact print head by selectively moving portions of said impact print head toward said plated, with ink being transferred from said printing ribbon to said first side of said document.

* * * * *